United States Patent [19]

Bauer et al.

[11] Patent Number: 4,566,421

[45] Date of Patent: Jan. 28, 1986

[54] APPARATUS FOR THE RPM-DEPENDENT ADJUSTMENT OF THE TIMING OF AN INJECTION PUMP

[75] Inventors: Otto Bauer, Munich; Lernhard Eberl, Lohhof; Gerhard Geyer, Munich; Max Straubel, Stuttgart, all of Fed. Rep. of Germany

[73] Assignee: Robert Bosch GmbH, Stuttgart, Fed. Rep. of Germany

[21] Appl. No.: 539,881

[22] Filed: Oct. 7, 1983

[30] Foreign Application Priority Data

Oct. 21, 1982 [DE] Fed. Rep. of Germany ..... 3238926

[51] Int. Cl.[4] ..... F02M 39/00

[52] U.S. Cl. ..... 123/502; 464/2

[58] Field of Search ..... 123/502, 501, 500; 464/25, 2; 417/206, 218, 253

[56] References Cited

U.S. PATENT DOCUMENTS

| | | | |
|---|---|---|---|
| 2,107,070 | 2/1938 | Fleory | 464/2 |
| 3,004,410 | 10/1961 | Pierce | 464/2 |
| 3,050,964 | 8/1962 | Hogemann et al. | 464/2 |
| 3,258,937 | 7/1966 | Kranc et al. | 464/25 |
| 3,447,520 | 6/1969 | Drori | 123/502 |
| 3,718,127 | 2/1973 | Gates et al. | 123/502 |
| 4,231,330 | 11/1980 | Garcea | 464/2 |
| 4,305,367 | 12/1981 | Imasato | 123/502 |

FOREIGN PATENT DOCUMENTS

| | | | |
|---|---|---|---|
| 1805276 | 5/1973 | Fed. Rep. of Germany | 123/502 |
| 2312658 | 12/1976 | France | 123/502 |
| 779657 | 7/1957 | United Kingdom | 123/502 |

*Primary Examiner*—Carl Stuart Miller

*Attorney, Agent, or Firm*—Edwin E. Greigg

[57] ABSTRACT

An apparatus for the rpm-dependent adjustment of the timing of an injection pump for internal combustion engines (shaft-type injection adjuster), in which a rotationally driven primary part is connected in a rotationally coupled manner with a secondary part but with the rotational angle between them being variable. The connection is effected via an axially displaceable sliding sheath, which is positively connected via at least one of the parts via a bevel gear and simultaneously acts as an adjusting piston. The working face of this adjusting piston is supplied with a control pressure by a centrifugal force control piston supported in a separate transverse bore in the primary part, either directly or with the intermediacy of an additional control piston, with respect to which then the adjusting piston effecting the coupling between the driving part and the driven part is embodied as a followup piston. A central, inner shaft, which is supported in the driving part and driven part, assumes the function both of guiding the adjusting piston and the control piston disposed in the interior thereof and of supplying the pressure medium.

13 Claims, 5 Drawing Figures

APPARATUS FOR THE RPM-DEPENDENT ADJUSTMENT OF THE TIMING OF AN INJECTION PUMP

BACKGROUND OF THE INVENTION

The invention is based on an apparatus for the rpm-dependent adjustment of the timing of an injection pump. Many forms of apparatus for the rpm-dependent adjustment of the timing of injection pumps in internal combustion engines, which are also known as shaft-type injection adjusters, are known. In one known apparatus (U.S. Pat. No. 3,050,964), which also defines the field of the present invention, flyweights supported on the rotating part are provided, which move outward as the rpm increases and mechanically engage an axially displaceable valve member via protrusions which effect a lever translation. The valve member in turn then enables the supply of pressure medium to an annular groove in a sliding sheath. As a result, the sliding sheath undergoes an axial displacement in accordance with the rpm and thereby simultaneously changes the adjustment angle between the rotating primary part and a secondary part connected with the primary part in a rotationally coupled manner. This change in the adjustment angle is effected by the meshing of a bevel gear on the sliding sheath with at least one of the parts thus coupled rotationally with one another.

With decreasing rpm, a restoration of the valve member to its original position takes place as the result of spring pre-stressing, and the pressure medium is carried away to a pressure medium sump. The known apparatus is complicated in design and requires a mechanical operative connection between the displacement movement of the flyweights, which is effected by rpm variation, and a valve member effecting the control of the pressure medium. As a result, taking other control variables besides the rpm into consideration is at best made more difficult. Furthermore, it cannot be precluded that at low and medium rpm levels, at which the rpm-dependent adjusting member adjustment already begins, frictional influences may occur which are not always negligible.

In another known apparatus (U.S. Pat. No. 3 258 937) for adjusting the relative angle between rotating driving and driven parts, the pressure of a pressure medium is exerted continuously upon a displaceable piston element which is in a state of operational bevel-gear engagement with at least one of the parts. However, at low rpm the position of a valve member disposed in the path of pressure medium supply is influenced by flyweights to such an extent that an outlet to the pressure medium sump is opened; this outlet is closed off only when the rpm is sufficiently high, and the axial displacement of the piston element, which is embodied like a sliding sheath, takes place counter to the pressure of a spring acting upon it, and thus the change in adjustment angle takes place as well.

Types of apparatus for the rpm-dependent adjustment of the instant of injection in internal combustion engines are also known from U.K. Pat. No. 779 657; U.S. Pat. No. 3 447 520; U.S. Pat. No. 3 718 127; and German Auslegeschrift No. 1 805 276.

In U.K. Pat. No. 779 657, pistons which are subject to the action of a pressure medium and execute opposing movements in the radial direction are provided; they act mechanically via connecting elements upon coupling parts between the driven and the driving part in such a way that an adjustment in the rotary angle is effected. The supply of pressure medium is effected in a manner controlled in accordance with rpm by means of control slides supported in the pistons; these control slides are equipped with a cast part and during operation are subjected to centrifugal forces.

In the fuel supply apparatus of U.S. Pat. No. 3 447 520, a relative angular rotation of a cam path variously determining the instant of injection takes place under the influence of a piston movable by a fluid pressure; the fluid pressure itself is picked up directly from the outlet of the feed pump, which (since the feed pump is driven in accordance with rpm) is likewise supposed to vary with the rpm of the engine. The genuine detection of rpm by the use of flyweights is therefore not effected in this known apparatus.

In the hydraulic regulator of U.S. Pat. No. 3 718 127, an rpm-dependent control pressure is generated by a separate modulation valve device, which is driven by rpm; this control pressure is transmitted to a posterior face of a piston, the control movement of which is exerted via a lever upon the metering device of a fuel injection pump.

Finally, the regulator device according to German Auslegeschrift No. 1 805 276 contains a regulator disposed in a connecting line between a high-pressure pump and a low-pressure pump; the regulator operates under the influence of centrifugal forces dependent on engine rpm and is embodied as a pressure medium control slide, having annular grooves for opening and closing pressure medium conduits. As a result, an adjusting device including a piston is triggerable such that an rpm-dependent regulation of the instant of injection is attained.

OBJECT AND SUMMARY OF THE INVENTION

The apparatus according to the invention has the advantage over the prior art that the rpm-dependent pressure is generated internally in the rotating adjuster, offering the opportunity of superimposing other control variables, introduced from outside, upon the pressure signal.

The control pressure generated by the flyweight part can be simultaneously used—that is, directly—as the working pressure which effects the displacement of the adjusting piston (a bevel-geared sliding sheath) operating counter to a restoring spring. In this sense, the control pressure generated by the flyweight part or the auxiliary piston acts as the working pressure. To avoid pressure peaks resulting from load surges and which can affect the flyweight part, a check valve may be disposed in the pressure medium line.

The compact and simplified design of the hydraulic, pressure-controlled shaft-type injection adjuster according to the invention is further assured in an advantageous manner by the disposition of a central shaft which serves simultaneously as both a guide means and a pressure medium supply means.

As a result of the characteristics disclosed, advantageous further developments of and improvements to the apparatus disclosed are possible. It is particularly advantageous for the rpm measuring member to be embodied especially as a pressure-generating flyweight part and simultaneously as a control piston, by which only a control pressure reaches and is exerted upon a second control piston. This second control piston hereby undergoes a displacement and then either permits the supply of the control pressure generated by the rpm measuring member, in order to displace the control piston, or under the influence of the control pressure from the rpm measuring member, it supplies the adjusting piston with the full available working pressure (system pressure). As a result, there is an advantageous separation of the circulatory system of the control pressure from the working pressure, affording the further advantages of a control pressure which is necessarily exact, because load pressure peaks cannot affect the centrifugal regulator; of optimal exploitation of the available working pressure for adjustment purposes; and of an automatic elimination of load-dictated incorrect settings, with a consistent avoidance of an incorrect control pressure.

A further advantage is offered by the embodiment of the flyweight as a stepped control piston, as a result of which high control pressures can be attained, even though the mass of the piston is within realizable limits.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
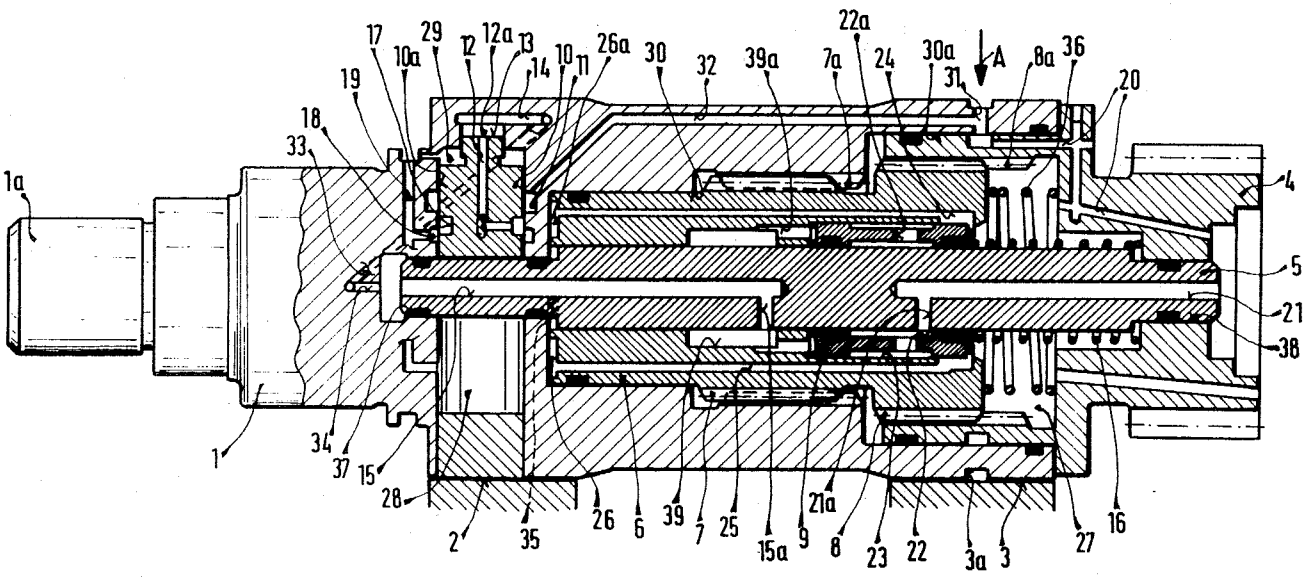
FIG. 1 shows a detailed form of the present invention in cross section.

In the comprehensively embodied exemplary embodiment shown in FIG. 1, which includes many, sometimes merely optional, versions, the drive is effected via a driving part 1 embodied like a housing, which will also be called the primary part. This driving part 1 or housing of the shaft-type injection adjuster, as it is also known in the field—which in this instance relates especially to a hydraulic pressure-controlled shaft-type injection adjuster having an integral rpm measuring member—shown in FIG. 1 is supported for instance at 2 and 3 and is itself rotationally driven via a front shaft stub 1*a*. The driving part 1 can however also be driven via a gear wheel either wedged against it or embodied in one piece with it and disposed at some suitable location on it. The output or off-drive is effected at the output or driven part 4, which can also be called the secondary part and is supported in the housing form of the driving part 1. The driving part therefore also has a substantially cup-shaped cylindrical shape with a stepped inner bore 30, which in the outer, offset bore part 30*a* receives the driven part and in this sense relevantly, and also rotatably, supports for the pressure-controlled, relative rotary-angle adjustment between the driving part 1 and the driven part 4. The stepped bore parts leading further inward then substantially serve to support and receive coupling elements in general, which effect a rotationally coupled connection between the driving part and the driven part.

In the illustrated exemplary embodiment, this connection between the driving and the driven side is effected via an adjusting piston 6 in the form of a sliding sheath or a ring, which with external bevel gears 7, 8 moving in opposite directions meshes with corresponding inner bevel gears 7*a*, 8*a* in the driving part 1 or the driven part 4. It will be understood that one of the bevel gear pairs 7, 7*a* or 8, 8*a* may instead be a straight gear or an axially extending wedge groove connection, because in this case as well, the basic function of the shift in the relative adjustment angle between the primary part and the secondary part which is provided by such a combination is assured, in fact by means of the axial displacement of the adjusting piston 6.

This axial displacement of the adjusting piston 6 is effected by delivering a pressure medium into an annular chamber 26 on the bore bottom in the driving part 1, as a result of which the adjusting piston effects a corresponding shift in rotary angle. The following discussion will address the design and function of the elements which effect the controlled supply and delivery of pressure medium to the adjusting piston, primarily in accordance with the rpm.

For rpm signal generation, an auxiliary piston primarily controlling the supply of pressure medium is provided, which piston, because it executes its displacement movement under the influence of centrifugal force and therefore in accordance with the rpm of the driving part 1, will in the following description be called the centrifugal force control piston 10. The centrifugal force control piston 10 is supported such that it slides as it is displaced in a radially extending transverse bore 10*a* in the driving part 1 and has annular or control grooves and bores, which serve to supply the pressure medium to the adjusting piston 6 in an rpm-dependent manner and the disposition of which grooves and bores will be discussed in connection with the function of the centrifugal force control piston 10 to be explained below. The bearing 3 includes an annular groove 31 through which a generalized supply of pressure medium or oil is provided as indicated by the arrow A; this may, for example, relate to the existing system pressure or the oil pressure available in the engine. Via transverse and longitudinal conduits 31, 32, the working pressure delivered via the bearing 3 reaches an annular conduit 11 in the slide bearing bore 10*a* for the centrifugal force control piston 10 and upon the exertion of a corresponding centrifugal force associated with a specific rpm, which force causes the piston 10 to move outward, this pressure passes via the annular groove 17 and the inner bore 12 of the piston 10 and reaches a pressure chamber 12*a*, from whence the working pressure becomes effective against the end face 13 of the centrifugal force control piston 10. The same working pressure, building up in the pressure chamber 12*a*, is exerted via further bores 33 (shown in dotted lines), 34, and 15 communicating with the pressure chamber 12*a* and, in the simplest assumed case of a transverse bore 35 indicated by dashed lines, upon the pressure chamber 26 and thereby upon a working face 26*a* of the adjusting piston 6. This piston thereby undergoes an axial displacement corresponding to the particular pressure exerted on it and thus to the rpm of the driving part 1. In this case, the pressure signal (control pressure) generated by the rpm measuring member simultaneously forms the working pressure acting upon the adjusting piston 6; the adjusting piston 6 can also operate counter to a restoring spring 36, in case the restoring force resulting from the transmitted torque should be considered insufficient. The restoring spring 36 is disposed in a chamber 27 in which it is supported against the driven part 4; the chamber 27 serves as a free chamber for receiving the adjusting piston 6 upon its displacement. This first possibility for evaluating the control pressure, generated by the centrifugal force control piston, as a working pressure and various embodiments associated with this possibility will be discussed further below, referring to FIGS. 2–5. In the present more-detailed exemplary embodiment now being discussed, the control pressure generated by the centrifugal force control piston 10 serves merely indirectly to displace the adjusting piston 6; at first, it directly effects an adjustment of a further control piston 9 instead.

In terms of the design, the following points should also be noted at this time. A continuous shaft 5, which in the present exemplary embodiment is stepped, is supported centrally in bearing bores 37 and 38 at the ends of the driving part 1 and driven part 4, respectively; this shaft 5 serves to guide and support the adjusting piston 6 and the just-mentioned addition control piston 9 as well as serving to supply pressure medium. Thus, the pressure medium supply bore 15, for instance, is machined into the shaft 5 along with the transverse bore 35. Also, the entire available working pressure travels from the annular inlet groove 3*a* into the inlet bore 31 via bores 20, a longitudinal shaft bore 21 having a transverse bore 21*a*, to an annular groove 22 of the control piston 9 and is there available for use.

The control pressure generated by the centrifugal force control piston 10 on the other hand travels via the longitudinal shaft bore 15 with the transverse bore 15*a* to an inner annular groove 39 in the adjusting piston 6 and from there via connecting conduits 39*a* to the working face of the further control piston 9. Thus the control piston 9 is acted upon via the bores 33, 34, 15 and 15*a* by the same pressure (control pressure) which is also exerted upon the face 13 of the centrifugal force control piston 10. This control pressure builds up in the various pressure chambers and bores until such time as the pressure exerted on the face 13 of the centrifugal force control piston 10 overcomes the influence of centrifugal force and the centrifugal force control piston 10 is brought into a position which closes off the pressure inflow via the annular conduit 11. On the other hand, if the rpm decreases, then the control pressure overcomes the influence of centrifugal force and the centrifugal force control piston 10 moves inward. In that case, the annular groove 17 then comes to coincide with an annular groove 18 having an outflow bore 19, leading for instance to a pressure medium sump, and the control pressure can be decreased until the pressure against the face 13 and the effect of centrifugal force are again in balance. Accordingly, because of the effect of the rpm measuring member in the pressure chambers and bores which set the standard, a control pressure results which is proportional to the centrifugal force and thus to the rpm or which corresponds to the square of the rpm; this control pressure exerts a specific force on the spring 16 and thus results in a definite, rpm-dependent position on the part of the control piston 9.

The manner in which the cooperation between the adjusting piston 6, acting as the working piston, and the control piston 9 as illustrated shows that the adjusting piston 6 is embodied as a follower piston of the control piston 9. Therefore, if the control piston 9, under the influence of the control pressure, say at increasing rpm, moves to the right as seen in the plane of the drawing in FIG. 1, then the entire available working pressure, which is present at the inner annular groove 22 and, via the connecting conduit 22*a*, at the outer annular groove 23 as well of the control piston, acts via the annular groove 24 in the working piston 6 and the connecting bore 25 leading to the rear pressure chamber 26 upon the working face 26*a* of the adjusting piston 6. The axial movement of the adjusting piston 6 then follows the control piston 9 until such a time as the annular groove 24 is once again closed by the control edge formed by the cooperation of the two annular grooves 24 and 23. Via the bevel gearing, as already mentioned above, this axial displacement of the adjusting piston 6 then generates a rotation of the primary and the secondary parts relative to one another, and thus effects a change in the adjustment angle. As a result, in this specialized application, a change is made in the instant of injection in accordance with rpm.

If the rpm drops, and if the control piston 9 thus moves to the left in the plane of the drawing, then via the annular groove 24 the control piston 9 opens the pressure chamber 26 with respect to the pressure-free chamber 27, and the adjusting piston 6 can move toward the left, under the influence of the moment transmitted or of a restoring spring 36 which may be present in the apparatus, until such time as the annular groove 24 is once again closed by the control piston 9. The relative adjustment angle between each other which is thereby assumed by the two parts, that is, the driving part 1 and the driven part 4, as the rotary drive is transmitted is thus a function of the rpm.

One advantageous embodiment of the present invention must be mentioned now in conection with what is shown in FIG. 1; it is possible, by means of further pressure chambers, pressure chamber 29 at the top and pressure chamber 28 at the bottom, which otherwise represents the pressure-free counterpart side acts upon the centrifugal force control piston 10, to impose further control variables in addition to the rpm, so that a superimposition of the control pressure effect upon a pressure dependent on other parameters is attained, and accordingly a modulation of the control pressure engaging the control piston is attained.

A further advantage in the exemplary embodiment of FIG. 1 is that load peaks, which make themselves felt in the form of load-dependent pressure peaks, cannot reach the centrifugal force regulating side; instead, they are automatically precluded from exerting any influence because of the subdivision of the apparatus into a control pressure zone and a working zone which utilizes the full available working pressure.

It is furthermore advantageous that, as also shown in FIG. 1, the control piston representing the centrifugal force may be stepped in embodiment, so that with a realizable mass high control pressures can still be attained. In an exemplary embodiment, for example, the control pressure may be at a level of $p_{St}=0.5 \ldots 1.7$ bar, at an injection adjuster rpm of $n_{SV}$, which is equal to the pump rpm $n_P$ and half the engine rpm $n_M/2$, which ranges from $535 \ldots 975\ \mathrm{min}^{-1}$. If the injection adjusterr pm is equal to the engine rpm, then a control pressure of $P_{St}=4$ bar can be built up.

Figure 2:
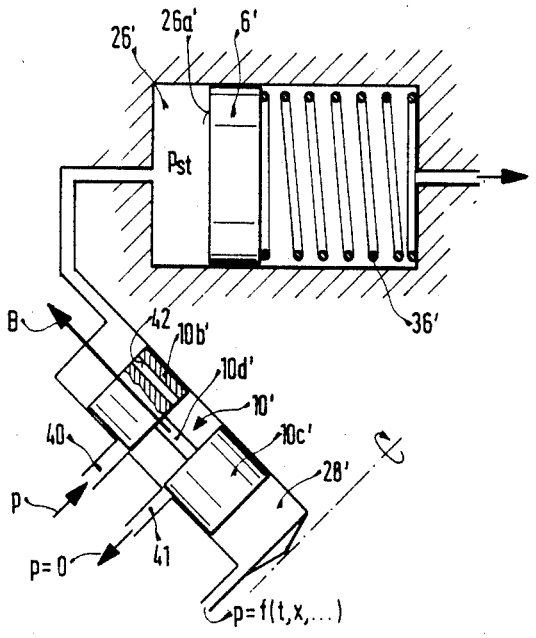
FIGS. 2–5 show in schematic form simplified forms of embodiments of functional relationships between the rpm measuring member and the adjusting piston which in the final analysis determines the adjustment angle between the driving part and the driven part augmented as needed by a further control piston.

The exemplary embodiment of FIG. 2, in part highly schematically shown, illustrates the simplified apparatus briefly mentioned above, that is, that the control pressure generated by the centrifugal force control piston 10 is provided directly as the working pressure to be exerted on the rear face of the adjusting piston. In FIG. 2, the adjusting piston is marked 6' and its pre-stressing spring as 36'; the movement of the centrifugal force control piston 10' occurring under the influence of centrifugal force is in the direction of the exerted centrifugal force, that is, in accordance with arrow B. The centrifugal force control piston 10' is embodied in two parts, having a front piston part 10b' and a rear piston part 10c' and a middle connecting rod 10d'. The rear pressure chamber 28' is pressurefree or receives a modulated pressure medium supply dependent on other parameters; the system pressure p is supplied via the inlet 40; a pressure medium outlet is marked 41. As soon as the centrifugal force control piston 10' moves in the direction of the arrow in response to centrifugal force, the inlet 40 is opened up via the annular groove formed between the two piston parts 10b' and 10c', and the control pressure thus made dependent on the rpm in accordance with an appropriate function travels via a bore 42 in the front piston part and is exerted on the working face 26a' of the adjusting piston 6'. The control pressure generated by the centrifugal force control piston 10' thus serves simultaneously as a working pressure exerted counter to a restoring spring.

Figure 3:
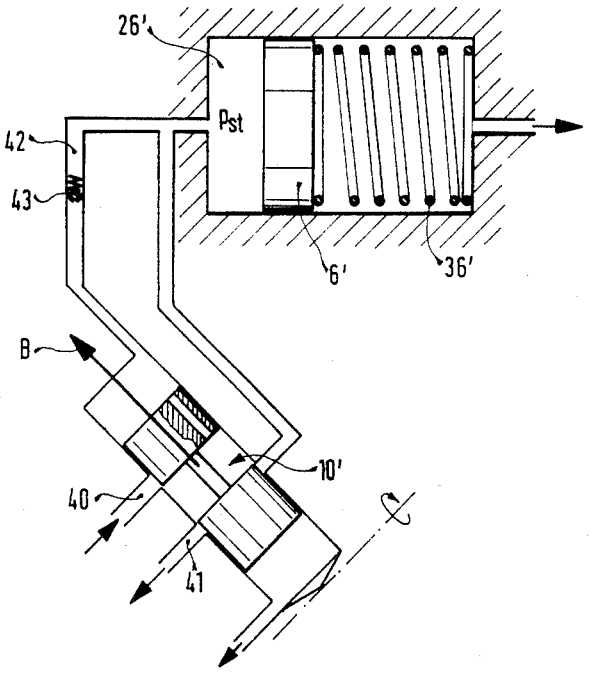

In the following exemplary embodiments of FIGS. 3, 4 and 5, identical parts are identified by identical reference numerals; the difference from the exemplary embodiment of FIG. 2 is, in FIG. 3, the fact that a check valve 43 is disposed in the line 42 leading to the pressure chamber 26', thereby preventing pressure peaks which may occur—as a result of load surges—from having an effect on the centrifugal force control piston 10'. Here, again, the control pressure serves directly as the working pressure for the adjusting piston 6'.

Figure 4:
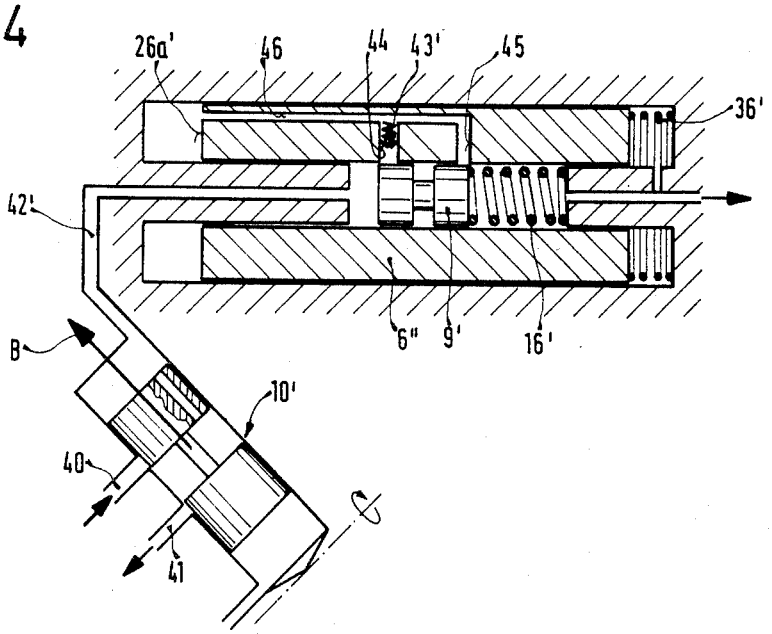

In the exemplary embodiment of FIG. 4, the adjusting piston zone is changed to the extent that next to the adjusting piston 6'' an inwardly disposed control piston 9' is provided, having its own pre-stressing spring 16'. The control pressure generated by the centrifugal force zone and delivered via the connecting line 42' serves to adjust the control piston 9', which in turn then either opens or closes transverse bores 44, 45 disposed in the adjusting piston 6'', so that via the axial bore 46 in the adjusting piston 6'' the control pressure can be exerted upon the working face 26a' thereof. Optionally, a check valve 43' may again be disposed in the line 44, having the same function as the check valve 43, that is, to prevent load surges from reaching the flyweight zone.

Figure 5:
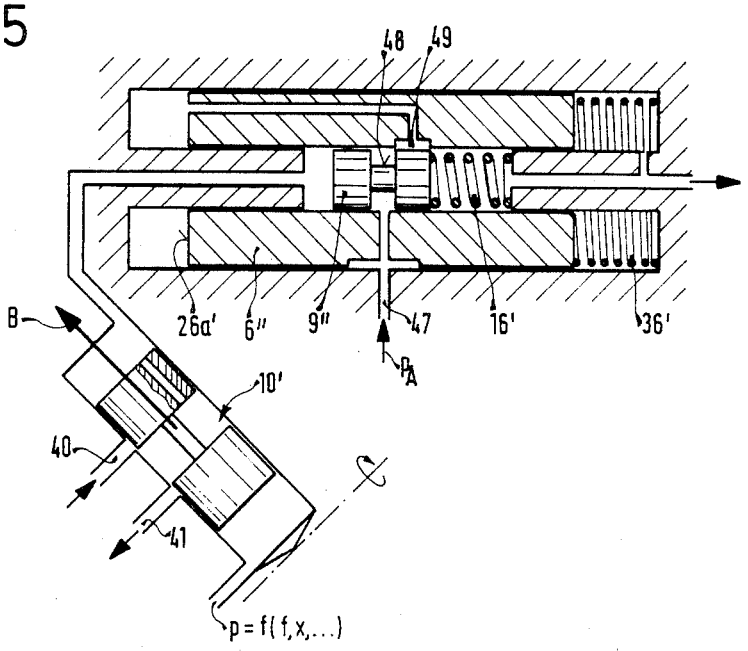

Finally, FIG. 5, in highly schematic form, shows what has been addressed above with respect to FIG. 1 and the more-detailed design of a hydraulic, pressure-controlled shaft-type injection adjuster having an integral rpm measuring member, namely the supply of the full working pressure $p_A$ at an inlet 47, where only the control piston 9'' is adjusted by the control pressure and then in turn, via its annular groove 48, opens up the inflow 49 for the full working pressure to reach the working face 26a' of the adjusting piston 6''.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for the rpm-dependent adjustment of the timing of an injection pump for internal combustion engines, embodied as a shaft-type injection adjuster, comprising a driven part connected with a rotationally driven driving part via an axially displaceable, sheath-like adjusting piston in a rotationally coupled manner with a relative rotary angle between the driven and the driving part being adjustable, said adjusting piston being axially displaceable thereby effecting a variation of the rotary angle between the driving and the driven part, said adjusting piston being supplied with a hydraulic pressure medium controlled at least indirectly by rpm via the influence of centrifugal force, an auxiliary piston which directly under the influence of said centrifugal force forms a centrifugal force control piston and is connected in such a manner to a pressure medium supply means that a control flow of pressure medium effected by the displacement of said centrifugal force control piston generates a pressure medium required for an axial displacement of the adjusting piston, wherein the control pressure generated by the centrifugal force control piston acts upon a control piston, which by means of an effected displacement permits a supply of the pressure medium to a working face of the adjusting piston.

2. An apparatus as defined by claim 1, wherein said control piston is supported in a slidably displaceable manner in the adjusting piston, and the control pressure generated by the centrifugal force control piston first acts upon a working face of the control piston, and then after opening the control piston via connecting conduit means acts upon said working face of the adjusting piston.

3. An apparatus as defined by claim 2, wherein a check valve is disposed in the connecting line in the adjusting piston carrying the control pressure to the working face of the adjusting piston.

4. An apparatus as defined by claim 1, wherein the control piston acted upon by the control pressure and the adjusting piston are disposed such that the adjusting piston acts as a followup piston with respect to the control piston.

5. An apparatus as defined by claim 1, which includes a central shaft which extends centrally of both the driving part and the driven part and is supported therein, said shaft including axially aligned passages through which the pressure medium is supplied and functions as a guidance and support for the adjusting piston acting as a coupling element between the driving part and the driven part, and wherein the driving part is embodied in cup-shaped fashion and has a central inner bore offset in a stepped manner, which supports the central shaft, the axially displaceable adjusting piston and a cylindrical protrusion zone of the driven part, each with an engagement between the driving part and the adjusting piston on the one hand and between the adjusting piston and the driven part on the other effected by bevel gears.

6. An apparatus as defined by claim 5, wherein the control piston is supported inside the adjusting piston and in a slidably displaceable manner on the central shaft.

7. An apparatus as defined by claim 1, wherein the centrifugal force control piston is supported in a slidably displaceable manner in a transverse bore in the driving part and a pressure medium supply is provided under the influence of annular grooves to the centrifugal force control piston, which supply also directs a pressure medium to a working face of the centrifugal force control piston opposite from where the centrifugal force is exerted and furthermore via connecting bores to a working face of the control piston.

8. An apparatus as defined in claim 5, wherein the central shaft has in addition to a control pressure bore a second bore which carries a full working pressure, in such a manner that the working pressure upon the opening up of an annular space by means of the control piston which is under the influence of control pressure is carried via further connecting bores and annular grooves to the working face of the adjusting piston in order to effect its axial displacement and dependency on the rpm.

9. An apparatus as defined in claim 1, wherein a restoring spring means applies a counter force upon the control piston and upon the adjusting piston, said restoring spring means supported on a bore bottom in the driven part.

10. An apparatus as defined by claim 1, wherein further pressure chambers are provided in the vicinity of the centrifugal force control piston for the imposition of further control variables by means of a supply of a pressure medium dependent on different parameters, with the modulation of the control pressure generated by the centrifugal force control piston.

11. An apparatus as defined by claim 1, wherein the control piston, by means of its effected displacement permits a supply of the fully available working pressure of the pressure medium supply means to the working face of the adjusting piston.

12. An apparatus as defined by claim 1 wherein a first restoring spring applies a counter force upon the control piston and said first restoring spring is supported on a bore in the driven part.

13. An apparatus as defined by claim 1 wherein a second restoring spring applies a counter force upon the adjusting piston and said second restoring spring is supported on a bore bottom in the driven part.

* * * * *